United States Patent [19]

Johnsen

[11] Patent Number: 5,030,029

[45] Date of Patent: Jul. 9, 1991

[54] ROAD BARRIER

[76] Inventor: Thore Johnsen, 2976 Islip Ct., Wantagh, N.Y. 11793

[21] Appl. No.: 474,492

[22] Filed: Feb. 2, 1990

[51] Int. Cl.[5] ..... E01F 13/00

[52] U.S. Cl. ..... 404/6; 404/10; 404/13; 404/14; 116/63 C; 116/202; 256/66; 256/13.1; 256/DIG. 6; 340/908.1

[58] Field of Search ..... 116/63 P, 63 R, 63 C, 116/63 T, 202; 404/6, 9, 10, 13, 14; 256/59, 67, 60, 65, 66, DIG. 6; 340/908.1

[56] References Cited

U.S. PATENT DOCUMENTS 4,289,302 9/1981 Montgomery ..... 256/65
4,674,431 6/1987 Cory ..... 116/202

FOREIGN PATENT DOCUMENTS 2084635 4/1982 United Kingdom ..... 404/6

*Primary Examiner*—Bruce M. Kisliuk
*Assistant Examiner*—Roger J. Schoeppel
*Attorney, Agent, or Firm*—Ladas & Parry

[57] ABSTRACT

An improved road barrier for channelizing traffic is provided and consists of a hollow pyramidal structure having a frustrum top. A base is formed on the bottom for stabilizing the pyramidal structure on a flat surface. A plurality of spaced apart bands are formed on the pyramidal structure for dividing it into a plurality of tiers with each tier having a plurality of panel faces so as to add strength to the pyramidal structure. At least one rib is formed on the frustrum top for mounting a warning light thereto.

16 Claims, 4 Drawing Sheets

ROAD BARRIER

BACKGROUND OF THE INVENTION

1. Field of the Invention

The instant invention relates generally to highway markers and more specifically it relates to an improved road barrier.

2. Description of the Prior Art

Numerous highway markers have been provided in prior art that are adapted to warn and alert drivers of hazards created by construction or maintenance activities in or near the traveled way and to guide and direct dirvers safely past the hazards. For example, U.S. Pat. Nos. 3,496,904 to Rimkus; 3,916,816 to Fitch; 3,952,690 to Rizzo et al; 4,083,033 to Kulp et al and 4,157,210 to Mesman are all illustrative of such prior art. While these units may be suitable for the particular purpose to which they address, they would not be as suitable for the purposes of the present invention as heretofore described.

SUMMARY OF THE INVENTION

A primary object of the present invention is to provide an improved road barrier that will overcome the shortcomings of the prior art devices.

Another object is to provide an improved road barrier being a hollow octagonal frustrum pyramid structure which will take the place of a standard cone or drum for channelizing the flow of traffic.

An additional object is to provide an improved road barrier in which a three tiered type pyramid structure is used to increase the overall height of the road barrier and can be utilized by themselves or be connected to a series of barrier board rails to form type I, II and III barricades.

A further object is to provide an improved road barrier that is simple and easy to use.

A still further object is to provide an improved road barrier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
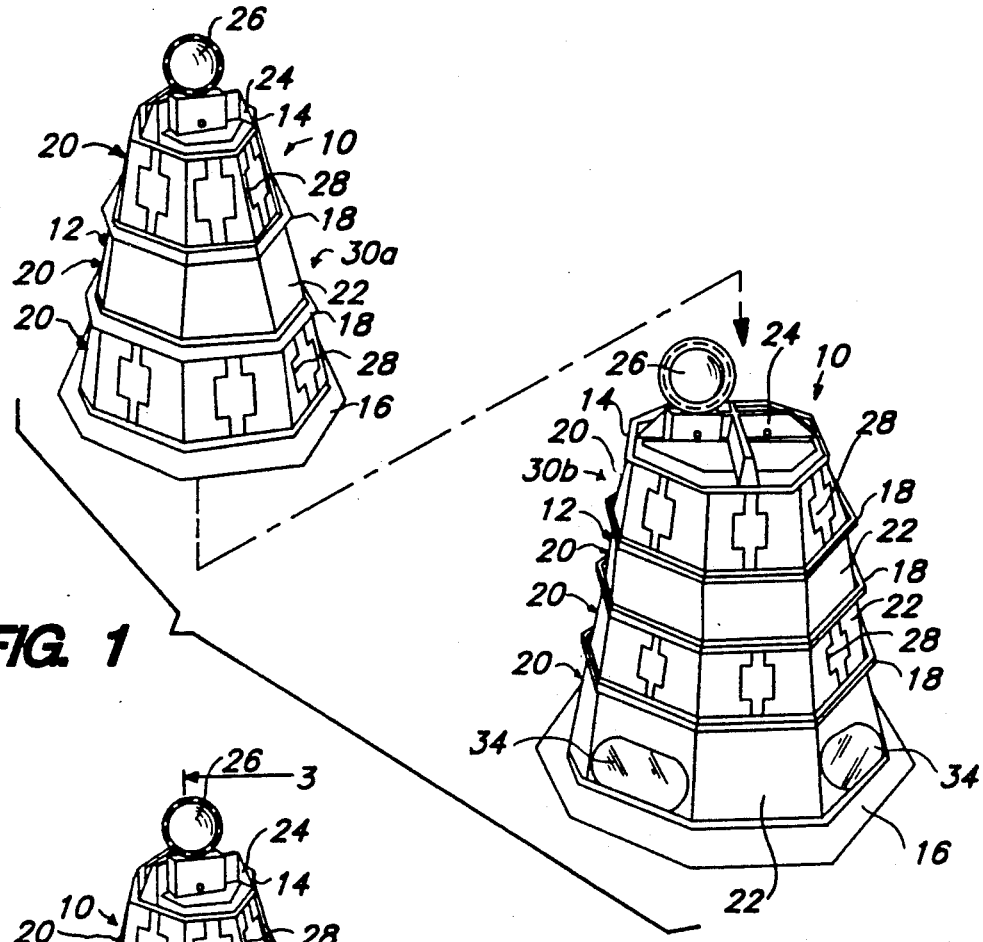
FIG. 1 is an exploded perspective view of the invention.
Figure 2:
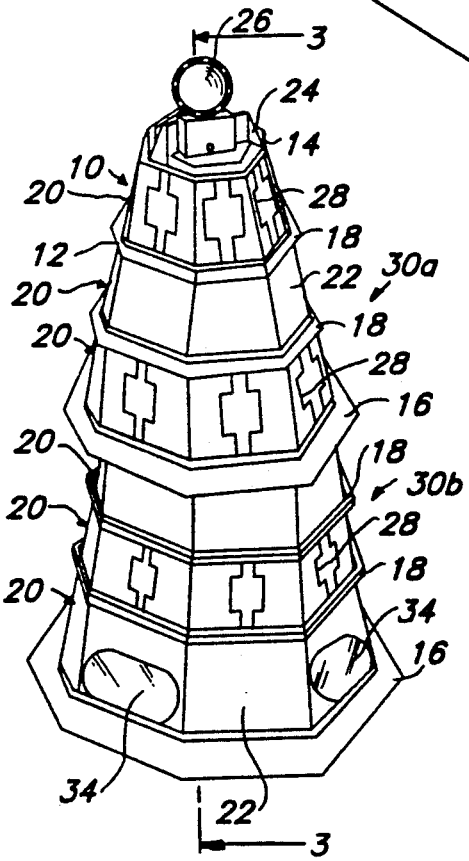
FIG. 2 is a perspective view of the invention in an assembled configuration.
Figure 3:
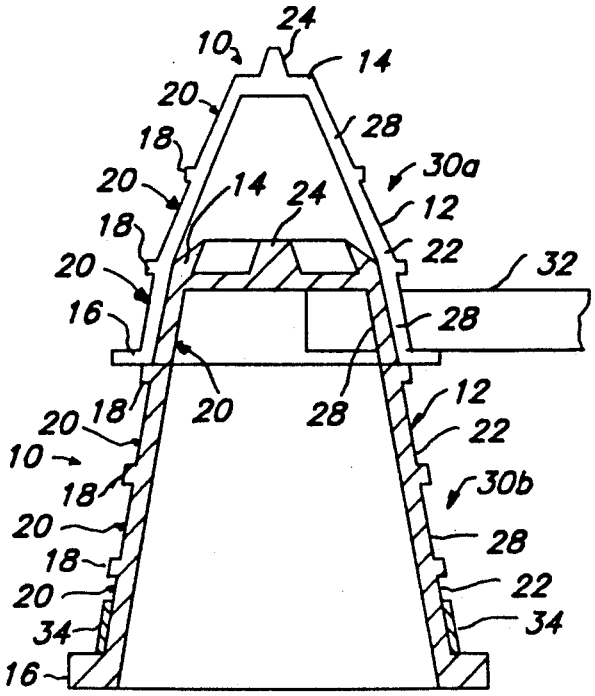
FIG. 3 is a cross sectional view taken along line 3—3 in FIG. 2.

Turning now descriptively to the drawings, in which similar reference characters denote similar elements throughout the several views, FIGS. 1 through 3 illustrate an improved road barrier 10 for channelizing traffic which comprises a hollow pyramid structue 12 having a frustrum top 14. A base 16 is formed on the bottom of the pyramid structure 12 for stabilizing the pyramid structure on a flat surface, such as a roadway. A plurality of spaced apart bands 18 are formed on the pyramid structure 12 for dividing the pyramid structure into a plurality of tiers 20, with each tier having a plurality of panel faces 22 so as to add strength to the pyramid structure 12. The panel faces slope inward from bottom to top. At least one rib 24 is formed on the frustrum top 14 of the pyramid structure 12 for mounting a warning light 26 thereto.

The pyramid structure 12, the base 16 and the bands 18 are octagonal shaped so that the panel faces 22 are eight in number in each of the tiers 20.

Figure 4:
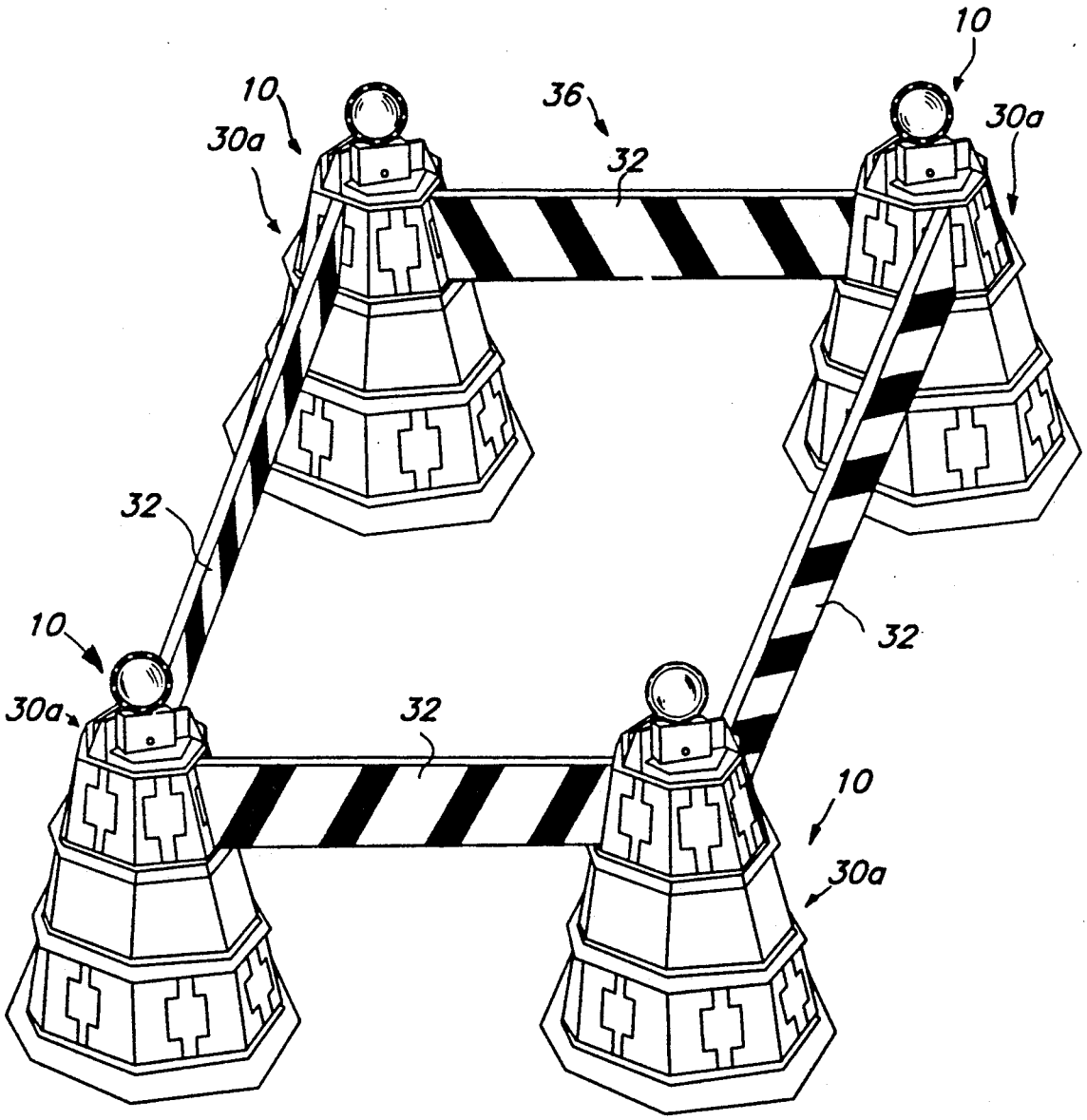
FIG. 4 is a perspective view of the invention in combination, being used in a type I barricade.
Figure 6:
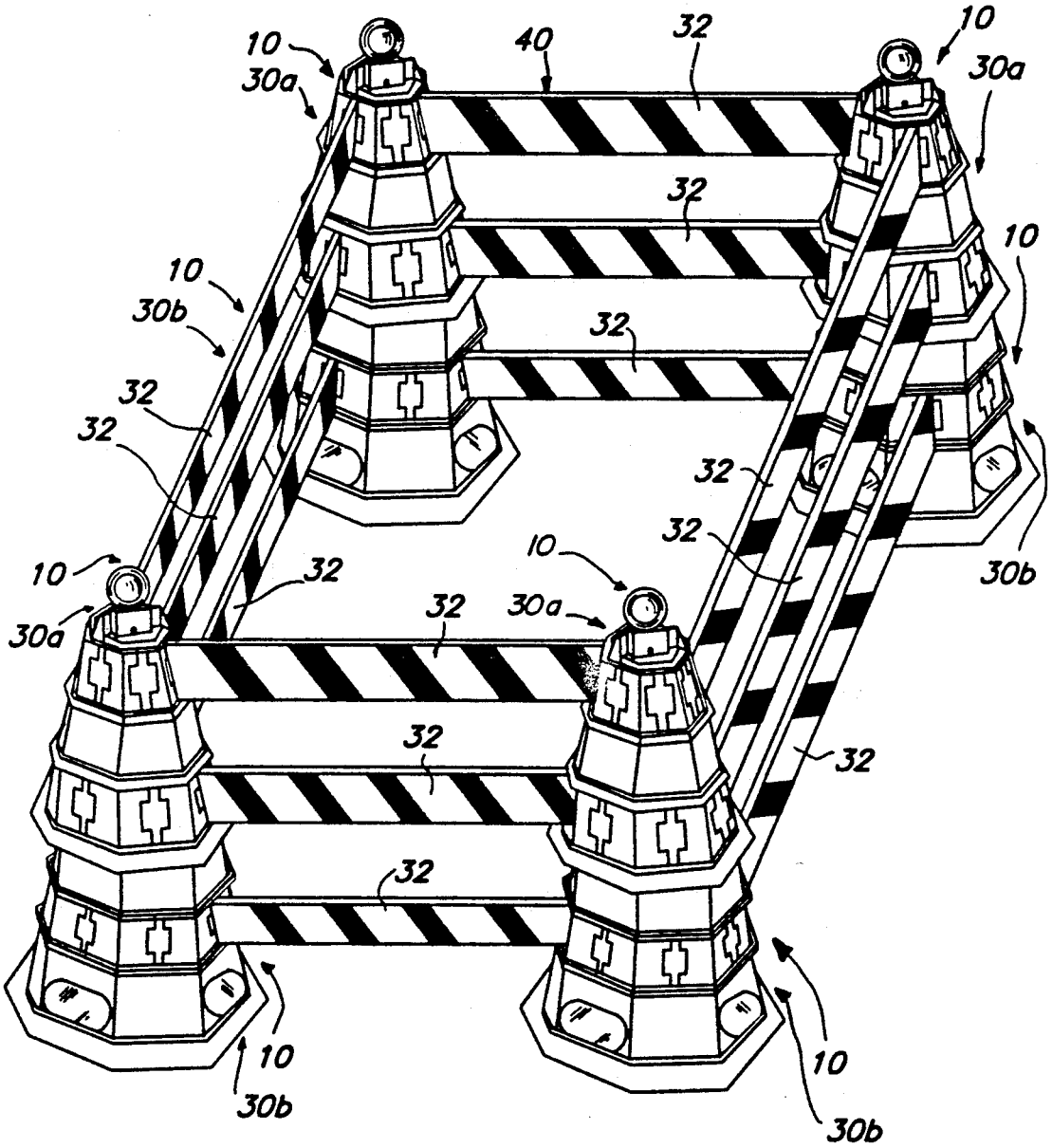
FIG. 6 is a perspective view of the invention in combination, being used in a type III barricade.

There are basically two types of improved road barriers 10 used in the invention, in which one being **30*a* (FIG. 1) contains two spaced apart bands 18 formed on the pyramid structure 12 for dividing the pyramid structure into three tiers 20 in which each of the panel faces 22 in the first and third tier 20 have a vertical slot 28 therethrough for receiving one end of a barrier board rail 32 (see FIGS. 4 and 6**).

Figure 5:
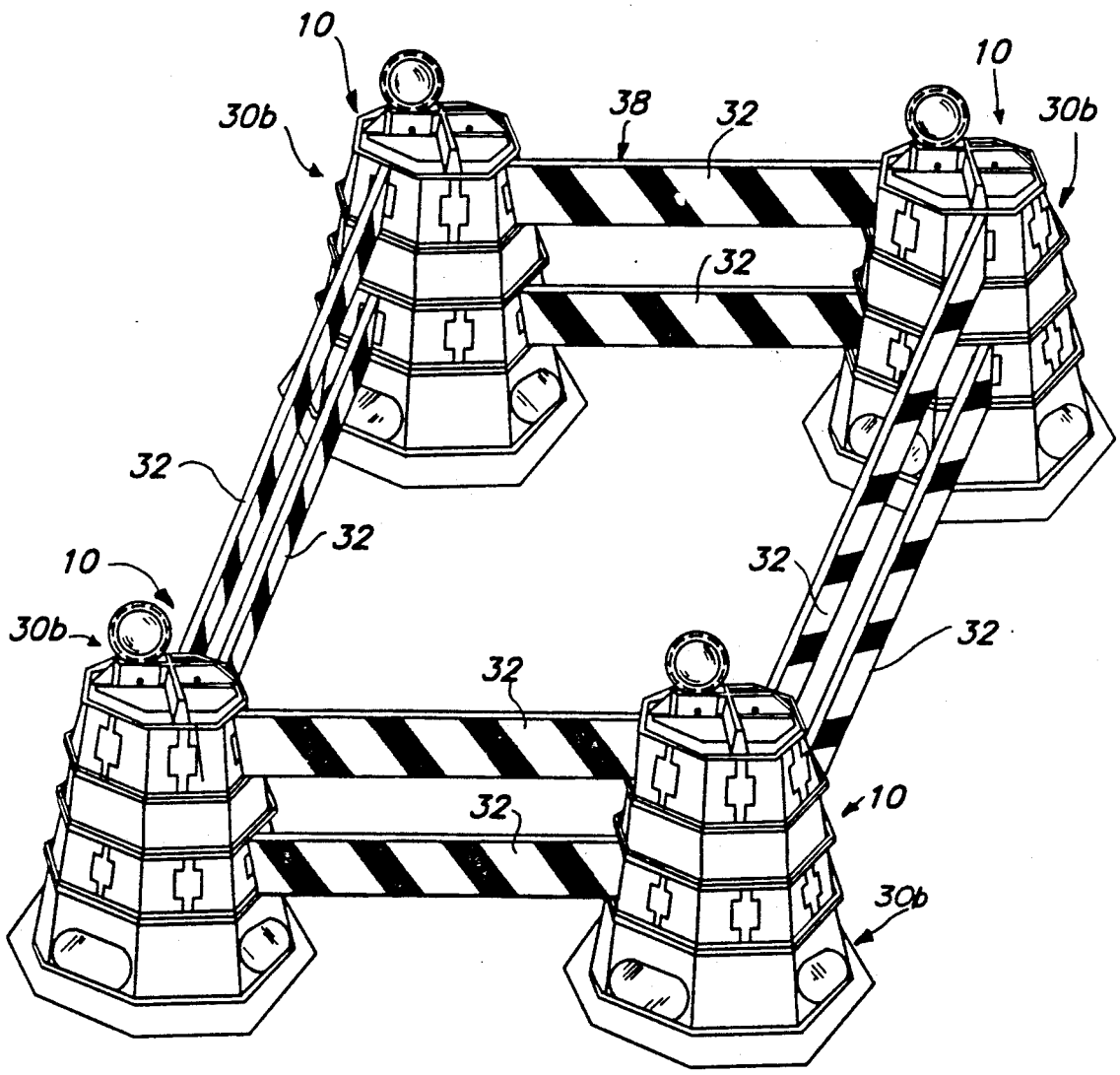
FIG. 5 is a perspective view of the invention in combination, being used in a type II barricade.

The other improved road barrier 10 used in the invention being **30*b* (FIG.1) contains three spaced apart bands 18 formed on the pyramid structure 12 for dividing the pyramid structure into four tiers 20 in which each of the panel faces 22 in the second and fourth tier 20 have a vertical slot 28 therethrough for receiving one end of a barrier board rail 32 (see FIGS. 5 and 6). Four reflectors 34 are each affixed to every other panel face 22 in the first tier 20 on the pyramid structure 12**.

The three tiered 20 pyramid structure 12 of the first type **30*a* (FIG. 1) is sized to fit upon (FIG. 2) the four tiered 20 pyramid structure 12 of the second type 30*b* (FIG. 1). The vertical slots 28 in the panel faces 22 in the first tier 20 of the three tiered pyramid structure 12 of the first type 30*a* will overlap and be in alignment with the vertical slots 28 in the panel faces 22 in the fourth tier 20 of the four tiered pyramid structure 12 of the second type 30*b* and be held together by at least one barrier board rail 30 (see FIG. 6). A clip or a short board (not shown) can also be used in holding the first type 30*a* to the second type 30*b***.

The first type **30*a* improved road barrier 10 and the second type 30*b* improved road barrier 10 can be used spearately as shown in FIG. 1 or together as shown in FIGS. 2 and 3 in place of the standard cone or drum. FIG. 4 shows four of the first type 30*a* of the improved road barriers 10 used together with four barrier board rails 32 in forming a type I barricade 36. FIG. 5 shows four of the second type 30*b* of the improved road barriers 10, used together with eight barrier board rails 32 in forming a type II barricade 38. FIG. 6 shows four of the first type 30*a* of the improved road barriers 10 on top of each of the second type 30*b* of the improved road barriers used together with twelve barrier board rails 32 in forming a type III barricade 40**.

The first type **30*a* and the second type 30*b* improved road barriers 10** can be fabricated out of plastic, wood, metal or other durable materials and can be colored orange and white as other channelizing devices are.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved road barrier for channelizing traffic comprising:

a. at least one hollow pyramidal structure having a frustum top;

b. a base formed on the bottom of said pyramidal structure for stabilizing said pyramidal structure on a flat surface;

c. a plurality of spaced apart bands formed on said pyramid structure for dividing said pyramidal structure into a plurality of tiers, with each said tier having a plurality of panel faces so as to add strength to said pyramidal structure, said panel faces sloping inward from bottom to top; and d. means on said frustum top of said pyramidal structure for mounting a warning light thereto.

2. An improved road barrier as recited in claim 1, wherein said pyramidal structure, said base and said bands are octagonal shaped so that said panel faces are eight in number in each of said tiers.

3. An improved road barrier as recited in claim 2, wherein said spaced apart bands are three in number and are formed on a second pyramidal structure for dividing said second pyramidal structure into four tiers in which each of said panel faces in the second and fourth tier have a vertical slot passing therethrough for receiving one end of a barrier board rail.

4. An improved road barrier as recited in claim 1, wherein said at least one pyramidal structure comprises first and second pyramidal structures and at least one barrier board rail, wherein said spaced apart bands are two in number and are formed on each said pyramidal structure for dividing each said pyramidal structure into three tiers in which each of said panel faces in said first and said third tiers has a vertical slot passing therethrough for receiving one end of said barrier board rail, each end of said barrier rail being received in a vertical slot of one of said pyramidal structures.

5. An improved road barrier as recited in claim 1, wherein said at least one pyramidal structure comprises first and second pyramidal structures and at least one barrier board rail, wherein said spaced apart bands are three in a number and are formed on each said pyramidal structure for dividing each said pyramidal structure into four tiers in which each of said panel faces in said second and fourth tier has a vertical slot passing therethrough for receiving one end of said barrier board rail, each end of said barrier rail being received in a vertical slot of one of said pyramidal structures.

6. An improved road barrier as recited in Claim 5, further including four reflectors each affixed to every other said panel face on said first tier on said pyramidal structures.

7. An improved road barrier as recited in Claim 1, wherein said at least one pyramidal structure comprises first and second pyramidal structures, wherein:

said first pyramidal structure has two said spaced apart bands formed thereon dividing said first pyramidal structure into three said tiers, in which each of said panels faces in said first and said third tiers has a vertical slot passing therethrough;

said second pyramidal structure has three said spaced apart bands formed thereon dividing said second pyramidal structure into four said tiers, in which each of said panel faces in said second and said fourth tiers has a vertical slot passing therethrough; and said first pyramidal structure is sized so that it may be placed atop said second pyramidal structure, such that said vertical slots in said panel faces in said first tier of said first pyramidal structure aligns with said vertical slots in said panel faces in said fourth tier of said second pyramidal structure.

8. An improved road barrier as recited in claim 7 wherein said first and second pyramidal structures are held together by at least one barrier board inserted into at least one pair of said aligned vertical slots on said first and second pyramidal structures.

9. An improved road barrier for use with barrier boards comprising:

a. pairs of first and second hollow pyramidal structures, each having a frustum top;

b. at least one band formed on each of said first pyramidal structures dividing them into a plurality of tiers, each tier of each of said first pyramidal structures having a plurality of panel faces, each of said panel faces in at least one tier having a vertical slot defined therethrough for receiving one end of a barrier board;

c. at least one band formed on each of said second pyramidal structures dividing them into a plurality of tiers, each tier having a plurality of panel faces, each of said panel faces in at least one tier of each of said second pyramidal structures having a vertical slot defined therethrough for receiving one end of a barrier board, said first pyramidal structures being sized to be placed atop said second pyramidal structures, such that when said first pyramidal structure is placed atop said second pyramidal structure, said vertical slots in said panel faces in said at least one tier of said first pyramidal structures align with said vertical slots in said panel faces in said at least one tier of said second pyramidal structures; and d. means to attach a warning light to the top of said first and second pyramidal structures.

10. An improved road barrier as recited in claim 9, wherein bases and bands of said first and second pyramidal structures are octagonal in shape so that said panel faces are eight in number on each of said tiers.

11. An improved road barrier as recited in claim 10, wherein said second pyramidal structures have reflectors affixed to every other panel face on said first tier thereof.

12. An improved road barrier as recited in cliam 10, wherein said first pyramidal structures are divided by two spaced apart bands into three tiers, said panel faces of said first and third tiers having said vertical slots therethrough, and said second pyramidal structures are divided by three spaced apart bands into four tiers, said panel faces of said second and fourth tiers having vertical slots therethrough, such that when said first pyramidal structures are placed atop said second pyramidal structures, the vertical slots in said panel faces of said first tiers of said first pyramidal structures align with said vertical slots in said panel faces of said fourth tiers of said second pyramidal structures.

13. An improved road barrier as recited in claim 12, wherein said first and second pyramidal structures have a base formed on the bottoms thereof and extending outward for stabilizing the pyramidal structures on a flat surface.

14. An improved road barrier as recited in claim 12 wherein said first and second pyramidal structures are held together by at least one barrier board inserted into at least one pair of said aligned vertical slots in said first and second pyramidal structures.

15. An improved road barrier for use with barrier boards comprising:

a. first and second hollow pyramidal structures, each having a frustum top;

b. panel faces formed on said first and second hollow pyramidal structures, said panel faces sloping inward from bottom to top of said first and second hollow pyramidal structures; and c. vertical slots formed through a plurality of said panel faces, each vertical slot being capable of receiving one end of a barrier board, wherein said first pyramidal structure is sized to be placed atop said second pyramidal structure such that when said first pyramidal structure is placed atop said second pyramidal structure, at least some of said vertical slots in said panel faces in said first pyramidal structure align with said vertical slots in said panel faces of said second pyramidal structure.

16. An improved road barrier as recited in claim 15, further comprising means to attach a warning light to the top of said first and second pyramidal structures.

* * * * *